US010221813B2

(12) United States Patent
Nakagawa

(10) Patent No.: US 10,221,813 B2
(45) Date of Patent: Mar. 5, 2019

(54) CONTROL DEVICE AND CONTROL METHOD FOR INTERNAL COMBUSTION ENGINE

(71) Applicant: Toyota Jidosha Kabushiki Kaisha, Toyota-shi, Aichi-ken (JP)

(72) Inventor: Masayoshi Nakagawa, Mishima (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 15/845,341

(22) Filed: Dec. 18, 2017

(65) Prior Publication Data

US 2018/0171942 A1 Jun. 21, 2018

(30) Foreign Application Priority Data

Dec. 21, 2016 (JP) ..... 2016-247870

(51) Int. Cl.

| | |
|---|---|
| ***F02D 41/02*** | (2006.01) |
| ***F02M 26/50*** | (2016.01) |
| ***F02D 21/08*** | (2006.01) |
| ***F02M 26/21*** | (2016.01) |
| ***F02M 26/47*** | (2016.01) |
| *F02M 26/00* | (2016.01) |
| *F02M 26/49* | (2016.01) |

(52) U.S. Cl.

CPC ..... *F02M 26/50* (2016.02); *F02D 21/08* (2013.01); *F02M 26/21* (2016.02); *F02M 26/47* (2016.02); *F02M 26/49* (2016.02); *F02M 2026/004* (2016.02)

(58) Field of Classification Search

CPC ..... F02M 26/50; F02M 26/21; F02M 26/47; F02M 26/49; F02M 2026/004; F02D 21/08; F02D 41/187; F02D 41/0072; F02D 41/0065; F02D 2041/0067; F02D 2041/007

USPC ..... 123/90.15, 568.21; 701/103, 108; 73/114.34

See application file for complete search history.

(56) References Cited

U.S. PATENT DOCUMENTS

| | | | | |
|---|---|---|---|---|
| 9,541,017 | B2 * | 1/2017 | Ulrey | F02D 41/0065 |
| 9,909,513 | B2 * | 3/2018 | Bzymek | F02D 41/0025 |
| 2004/0093866 | A1 * | 5/2004 | Ishikawa | F02M 26/07 60/605.2 |

(Continued)

FOREIGN PATENT DOCUMENTS

| | | | |
|---|---|---|---|
| JP | 2004-245077 | A | 9/2004 |
| JP | 2016-023589 | A | 2/2016 |

*Primary Examiner* — Hai Huynh

(74) *Attorney, Agent, or Firm* — Dinsmore & Shohl LLP

(57) ABSTRACT

An electronic control unit executes a deposit removal operation of removing a deposit accumulated in an intake port of an internal combustion engine. In the deposit removal operation, the temperature of an EGR gas that is recycled to an intake passage is measured or estimated. Then, a variable valve mechanism is operated such that an intake valve is opened in an expansion stroke or an exhaust stroke and the lift amount of the intake valve becomes larger as the measured or estimated temperature of the EGR gas becomes lower. Further, an external EGR device is operated such that the amount of the EGR gas that is recycled to the intake passage becomes larger as the measured or estimated temperature of the EGR gas becomes lower.

7 Claims, 12 Drawing Sheets

(56) References Cited

U.S. PATENT DOCUMENTS

2008/0216557 A1* 9/2008 Wang ..... F02D 35/025
73/23.31
2014/0158100 A1* 6/2014 Williams ..... F02M 25/0771
123/568.21

* cited by examiner

CONTROL DEVICE AND CONTROL METHOD FOR INTERNAL COMBUSTION ENGINE

CROSS-REFERENCE TO RELATED APPLICATIONS

This application claims priority to Japanese Patent Application No. 2016-247870 filed on Dec. 21, 2016, which is incorporated herein by reference in its entirety including the specification, drawings and abstract.

BACKGROUND

1. Technical Field

The present disclosure relates to a control device and a control method for an internal combustion engine, and specifically, relates to a control device and a control method that execute a deposit removal operation of removing a deposit accumulated in an intake port.

2. Description of Related Art

Japanese Patent Application Publication No. 2004-245077 (JP 2004-245077 A) discloses an internal combustion engine operating method for removing a deposit accumulated in an intake port. The method described in this document is a method of setting a fuel injection amount to a minimum injection amount and extending an overlap between an opening period of an intake valve and an opening period of an exhaust valve, with respect to a cylinder for which the deposit is removed. According to this method, it is possible to blow back a combustion gas from the target cylinder to the intake port in a state where the target cylinder is substantially stopped, and to burn up the deposit by the combustion gas.

However, after the completion of the combustion, the temperature of the combustion gas in the cylinder decreases rapidly. Therefore, in the method in which the valve overlap is used, it is not possible to blow back a combustion gas having a high temperature to the intake port. Particularly, in the case of diesel engines, which are lower in combustion temperature than gasoline engines, there is a concern that the blow-back of the combustion gas by the valve overlap does not allow the deposit to be sufficiently burnt up because of a low temperature of the combustion gas.

Hence, a method of blowing back a combustion gas having a higher temperature to the intake port by opening the intake valve again in a period from an expansion stroke to an exhaust stroke is considered. Japanese Patent Application Publication No. 2016-023589 (JP 2016-023589 A) describes the opening of the intake valve in the period from the expansion stroke to the exhaust stroke and a mechanism for the opening. Here, the object of the technique described in this document is not to burn up the deposit accumulated in the intake port. For burning up the deposit, it is desired to increase the amount of the combustion gas that is blown back to the intake port, as much as possible. However, in the technique described in this document, because a three-way catalyst is used, the amount of the combustion gas that is blown back to the intake port, that is, an internal EGR gas amount is adjusted such that an equivalent ratio of 1 is achieved.

SUMMARY

The disclosure provides a control device and a control method for an internal combustion engine that can burn up and remove the deposit accumulated in the intake port by blowing back as much combustion gas as possible to the intake port in the expansion stroke or the exhaust stroke.

A control device for an internal combustion engine according to a first aspect of the disclosure is a control device for controlling an internal combustion engine including: a variable valve mechanism that is capable of opening an intake valve in an expansion stroke or an exhaust stroke and changing a lift amount of the intake valve; and an external EGR device that recycles an EGR gas from an exhaust passage to an intake passage. The control device comprises an electronic control unit. The electronic control unit is configured to execute a deposit removal operation of removing a deposit accumulated in an intake port of the internal combustion engine. The deposit removal operation includes: measuring or estimating the temperature of the EGR gas that is recycled to the intake passage; operating the variable valve mechanism such that the intake valve is opened in the expansion stroke or the exhaust stroke, and the lift amount of the intake valve becomes larger as the measured or estimated temperature of the EGR gas becomes lower; and operating the external EGR device such that the amount of the EGR gas that is recycled to the intake passage becomes larger as the measured or estimated temperature of the EGR gas becomes lower.

According to the above deposit removal operation, the amount of the combustion gas that is blown back to the intake port is increased. Thereby, the amount of an internal EGR gas is increased, and corresponding to that, the amount of an external EGR gas is increased. When the external EGR gas is supplied by an amount corresponding to the amount of the internal EGR gas, the rise in cylinder temperature due to the internal EGR gas is suppressed, because the external EGR gas is lower in temperature than the internal EGR gas. Furthermore, according to the above deposit removal operation, the amount of the combustion gas that is blown back to the intake port and the amount of the external EGR gas are changed depending on the temperature of the external EGR gas. Therefore, as much combustion gas as possible can be blown back to the intake port, as long as no disadvantage is caused by the rise in the cylinder temperature.

The electronic control unit may be configured to determine an operation amount of the variable valve mechanism and an operation amount of the external EGR device depending on the measured or estimated temperature of the EGR gas, such that a fresh air amount ensuring that the air-fuel ratio of a cylinder gas does not fall below a rich limit to become rich is secured, when the electronic control unit executes the deposit removal operation. According to such a configuration, it is possible to suppress the generation of smoke caused by the air-fuel ratio becoming excessively low.

Furthermore, the electronic control unit may be configured to determine the operation amount of the variable valve mechanism and the operation amount of the external EGR device, such that the amount of a combustion gas that is blown back from the intake valve to the intake port is maximized, when the electronic control unit executes the deposit removal operation. According to such a configuration, it is possible to maximize the effect of burning up the deposit accumulated in the intake port by blowing back the combustion gas.

Further, the electronic control unit may be configured to execute the deposit removal operation, when it is estimated that a cylinder temperature at a time of combustion completion is equal to or higher than a predetermined temperature allowing the deposit to be removed. According to such a configuration, it is possible to reduce ineffective and useless operations and increase the certainty of the burning of the deposit accumulated in the intake port.

Furthermore, the electronic control unit may be configured to operate the variable valve mechanism, such that an opening timing of the intake valve is a timing of the combustion completion, when the electronic control unit executes the deposit removal operation. According to such a configuration, it is possible to blow back a high-temperature combustion gas just after the combustion completion, to the intake port, and to increase the effect of burning up the deposit by the combustion gas.

As described above, according to the control device, it is possible to increase the amount of the combustion gas that is blown back to the intake port while suppressing the rise in the cylinder temperature. Therefore, it is possible to burn up the deposit accumulated in the intake port without causing the deterioration in fuel economy performance or exhaust performance.

A control method of an internal combustion engine according to a second aspect of the disclosure is a control method of controlling an internal combustion engine including: a variable valve mechanism that is capable of opening an intake valve in an expansion stroke or an exhaust stroke and changing a lift amount of the intake valve; and an external EGR device that recycles an EGR gas from an exhaust passage to an intake passage. The control method executes a deposit removal operation of removing a deposit accumulated in an intake port of the internal combustion engine. The deposit removal operation includes: measuring or estimating the temperature of the EGR gas that is recycled to the intake passage; operating the variable valve mechanism such that the intake valve is opened in the expansion stroke or the exhaust stroke, and the lift amount of the intake valve becomes larger as the measured or estimated temperature of the EGR gas becomes lower; and operating the external EGR device such that the amount of the EGR gas that is recycled to the intake passage becomes larger as the measured or estimated temperature of the EGR gas becomes lower.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

1. Configuration of Internal Combustion Engine

Figure 1:
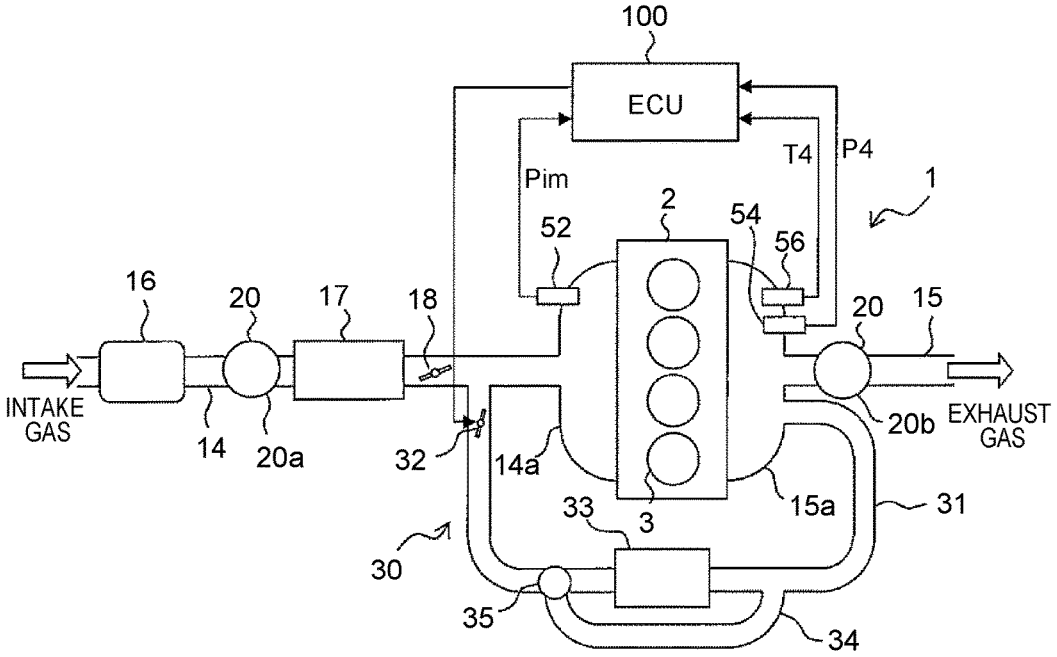
FIG. 1 is a schematic plan view showing an overall configuration of an internal combustion engine to which a control device in an embodiment of the disclosure is applied.

FIG. 1 is a schematic diagram showing an overall configuration of an internal combustion engine 1 to which a control device in an embodiment of the disclosure is applied. The internal combustion engine 1 according to the embodiment includes an engine body 2 configured as a diesel engine. The engine body 2 is provided with a plurality of (four, in the figure) cylinders 3. The engine body 2 is connected to an intake passage 14 through which fresh air is taken from the exterior, and an exhaust passage 15 through which exhaust gas is discharged to the exterior. In detail, the intake passage 14 is provided with an intake manifold 14*a* for distributing air to the respective cylinders 3, and the intake manifold 14*a* is connected to the engine body 2. The exhaust passage 15 is provided with an exhaust manifold 15*a* for collecting the exhaust gas discharged from the respective cylinders 3, and the exhaust manifold 15*a* is connected to the engine body 2. The intake passage 14 is provided with an air cleaner 16, a compressor 20*a* of a turbocharger 20, an intercooler 17 and an intake throttle valve 18, in the order from the upstream side to the downstream side. The exhaust passage 15 is provided with a turbine 20*b* of the turbocharger 20.

The internal combustion engine 1 includes an external EGR device 30 that recycles some of the exhaust gas from the exhaust passage 15 to the intake passage 14. The external EGR device 30 includes an EGR passage 31 that connects the upstream side from the turbine 20*b* of the exhaust passage 15 and the downstream side from the intake throttle valve 18 of the intake passage 14. On the EGR passage 31, an EGR cooler 33 and an EGR valve 32 are arranged m the order from the upstream side to the downstream side in the flow direction of EGR gas. The EGR passage 31 is provided with a bypass passage 34 that bypasses the EGR cooler 33. At a joining part where the bypass passage 34 joins the EGR passage 31, a bypass valve 35 that switches the flow channel of the EGR gas between the bypass passage 34 and the EGR cooler 33 is provided.

Figure 2:
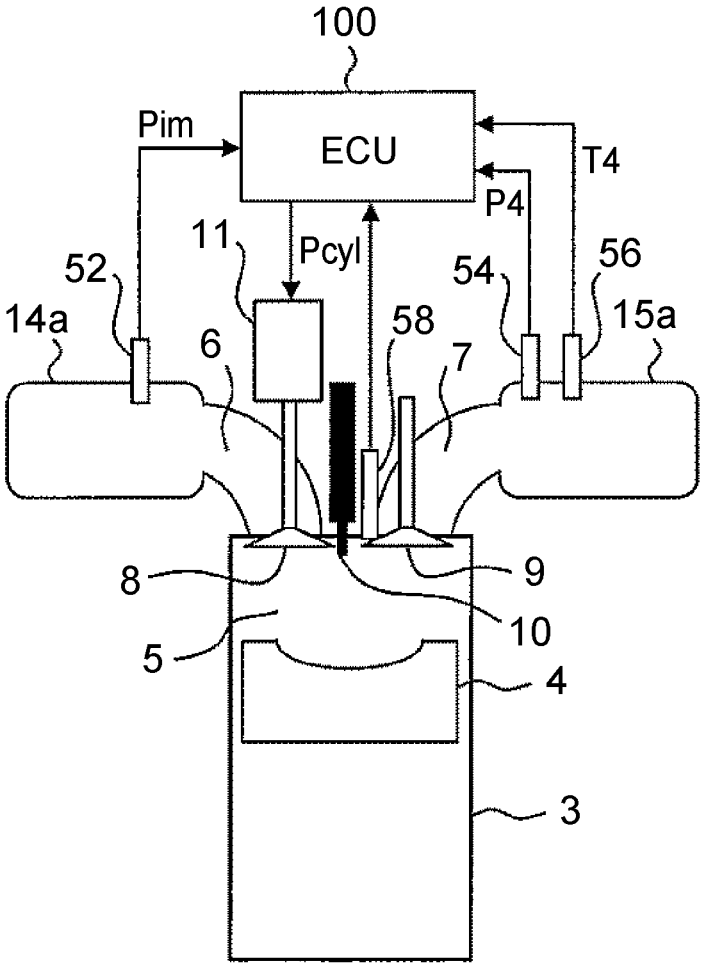
FIG. 2 is a schematic sectional view showing an overall configuration of an engine body of the internal combustion engine shown in FIG. 1.

Here, FIG. 2 is a schematic sectional view showing an overall configuration of the engine body 2. A piston 4 is disposed in each cylinder 3 provided in the engine body 2. A combustion chamber 5 is formed by an internal surface of the cylinder 3 and the piston 4. A fuel injection valve 10 is attached to a top part of the combustion chamber 5, so as to face the piston 4. The combustion chamber 5 is connected to the intake manifold 14*a* through an intake port 6, and is connected to the exhaust manifold 15*a* through an exhaust port 7. An intake valve 8 is provided at a connection part between the intake port 6 and the combustion chamber 5, and an exhaust valve 9 is provided at a connection part between the exhaust port 7 and the combustion chamber 5. A variable valve mechanism 11 is attached to the intake valve 8. The variable valve mechanism 11 is configured to be capable of opening the intake valve 8 twice in one cycle. In detail, the variable valve mechanism 11 is configured to be capable of performing the second opening of the intake valve 8 in an expansion stroke or an exhaust stroke, and further changing the lift amount of the intake valve 8 at this time. An action of the intake valve 8 that is realized by the variable valve mechanism 11 will be described in detail later. As a specific structure of the variable valve mechanism 11, a valve operating mechanism that realizes the action of the above-described intake valve 8 by switching a cam may be adopted, or an electromagnetic valve operating mechanism that drives the intake valve by a solenoid. Further, the variable valve mechanism disclosed in JP 2004-245077 A may be used in the embodiment.

A control device 100 that controls the internal combustion engine 1 is an electronic control unit (ECU) including at least one CPU, at least one ROM, and at least one RAM. In the ROM, a variety of programs for controlling the internal combustion engine 1 and a variety of data including maps are stored. The programs stored in the ROM are loaded in the RAM, and are executed by the CPU, so that various functions are realized in the control device 100. The control device 100 may be configured by a plurality of ECUs.

To the control device 100, a variety of information about operation state and operation condition of the internal combustion engine 1 is input from a variety of sensors attached to the internal combustion engine 1. For example, information about an intake manifold pressure (Pim) that is a pressure in the intake manifold 14*a* is input from a pressure sensor 52 disposed in the intake manifold 14*a*. Information about an exhaust manifold pressure (P4) that is a pressure in the exhaust manifold 15*a* is input from a pressure sensor 54 disposed in the exhaust manifold 15*a*. Further, information about an exhaust manifold temperature (T4) that is a temperature in the exhaust manifold 15*a* is input from a temperature sensor 56 disposed in the exhaust manifold 15*a*. Furthermore, information about a cylinder pressure (Pcyl) that is a pressure in the combustion chamber 5 is input from a pressure sensor 58 attached to a top part of the combustion chamber 5. The control device 100 determines control parameters for the internal combustion engine 1, based on at least these pieces of information.

2. Deposit Removal Operation

2-1. Twice-Opening Operation of Intake Valve

Operations of the internal combustion engine 1 that are performed by the control device 100 include a deposit removal operation of removing a deposit accumulated in the intake port 6. The deposit removal operation is an operation of blowing back a high-temperature combustion gas in the combustion chamber 5 from the intake valve 8 to the intake port 6 and burning up and removing the deposit by the heat of the combustion gas, by operating the variable valve mechanism 11 to open the intake valve 8 in the expansion stroke or the exhaust stroke. The deposit removal operation is not an operation that is constantly performed, and is executed at a timing that is predicted as a timing when a certain amount of a deposit is accumulated in the intake port 6. For example, the deposit removal operation is performed whenever the traveling distance of a vehicle reaches a predetermined distance, or whenever the operating time of the internal combustion engine 1 reaches a predetermined time.

Figure 3A:
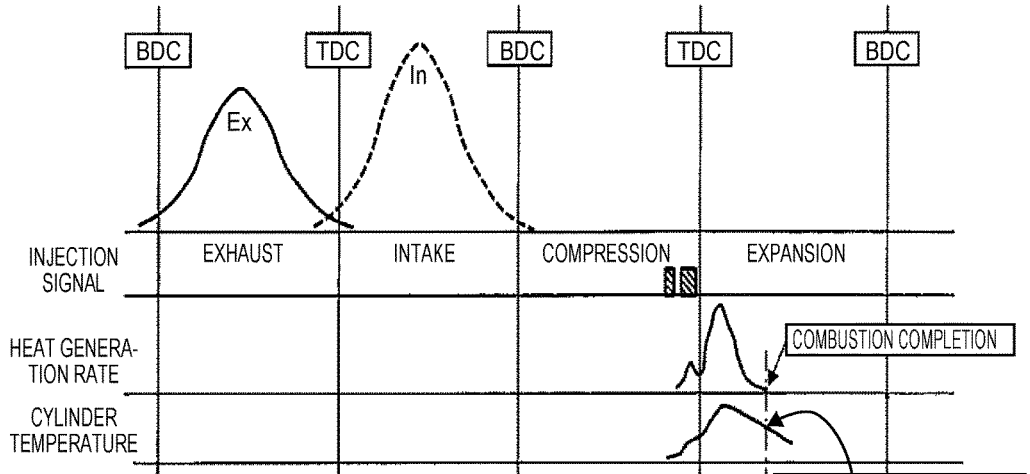
FIG. 3A is a time chart showing an action of an intake valve by the control device in the embodiment of the disclosure, and is a time chart showing an action of the intake valve at the time of normal operation.
Figure 3B:
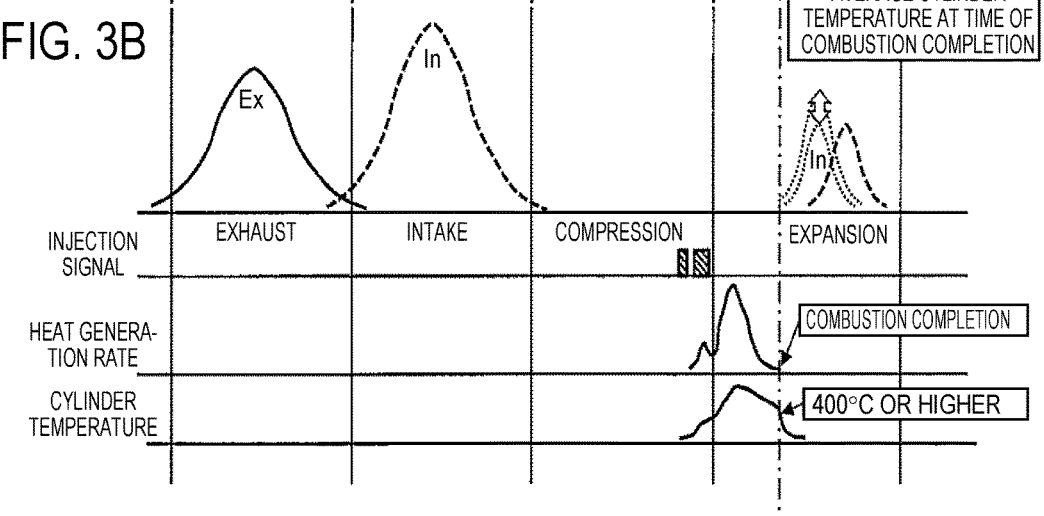
FIG. 3B is a time chart showing an action of the intake valve by the control device in the embodiment of the disclosure, and is a time chart showing an action of the intake valve in a deposit removal operation.

FIG. 3A is a time chart showing an action of the intake valve 8 at the time of normal operation, and FIG. 3B is a time chart showing an action of the intake valve 8 in the deposit removal operation. In each time chart, the abscissa indicates crank angle, the ordinate of the first stage indicates the lift amounts of the intake valve 8 and the exhaust valve 9, the ordinate of the second stage indicates an injection signal for the fuel injection valve 10, the ordinate of the third stage indicates heat generation rate, and the ordinate of the fourth stage indicates cylinder temperature. In the time chart of the first stage, the solid line indicates the lift amount of the exhaust valve 9, and the dotted line indicates the lift amount of the intake valve 8.

As shown in FIG. 3B, in the deposit removal operation, the intake valve 8 is opened after the completion of the combustion. When the heat generation rate calculated from the cylinder pressure becomes equal to or lower than zero or a threshold, it is determined that the combustion is completed. After the completion of the combustion, the cylinder temperature decreases with the change in the crank angle. Therefore, for blowing back a higher-temperature combustion gas to the intake port 6, it is desired that the timing of the second opening of the intake valve 8 is closer to the timing of the completion of the combustion. However, when the intake valve 8 is opened before the combustion is completed, unburnt fuel is also blown back to the intake port 6. Therefore, the timing of the second opening of the intake valve 8 is avoided from being earlier than the timing of the completion of the combustion. In some embodiments, the timing of opening the intake valve 8 is the timing when the combustion is just completed.

2-2. Determination of Internal EGR Gas Amount and External EGR Gas Amount

The effect of burning up the deposit by the combustion gas increases as the amount of the combustion gas that is blown back to the intake port 6 increases. However, the combustion gas that is blown back to the intake port 6 is taken again from the intake valve 8 to the combustion chamber 5 in the next intake stroke, to become an internal EGR gas. Therefore, when the amount of the combustion gas that is blown back to the intake port 6 is merely increased, the internal EGR gas having a high temperature occupies the combustion chamber 5, so that the cylinder temperature rises. In some embodiments, the cylinder temperature is not excessively raised, because fuel economy performance and exhaust gas performance decreases.

Hence, in the deposit removal operation that is performed by the control device 100, the rise in the cylinder temperature is suppressed using an external EGR gas. The external EGR gas, that is, the EGR gas that is introduced to the intake passage 14 by the external EGR device 30 is cooled by the EGR cooler 33, and therefore, is lower in temperature than the internal EGR gas. Therefore, it is conceivable that the rise in the cylinder temperature due to the increase in the internal EGR gas amount can be suppressed by introducing the external EGR gas depending on the amount of the combustion gas that is blown back to the intake port 6.

However, the internal EGR gas amount and the external EGR gas amount that can be introduced are limited. The limit is determined by a smoke limit air-fuel ratio. The smoke limit air-fuel ratio is a rich limit of the air-fuel ratio that allows the generation of smoke to be kept within a permissible range. When the air-fuel ratio of the cylinder gas falls below the smoke limit air-fuel ratio to become rich, there is a concern that the smoke over the permissible value is generated. The increase in the internal EGR gas amount and the external EGR gas amount decreases the amount of fresh air that enters the combustion chamber 5. Since the fuel injection amount is determined by a required torque for the internal combustion engine 1, the air-fuel ratio of the cylinder gas becomes lower when the fresh air amount decreases. In some embodiments, for maximizing the effect of burning up the deposit without decreasing the fuel economy performance and the exhaust gas performance, the internal EGR gas amount is maximized, while securing a fresh air amount that ensures that the air-fuel ratio of the cylinder gas does not become lower than the smoke limit air-fuel ratio.

Here, the smoke limit air-fuel ratio will be described in more detail. The smoke limit air-fuel ratio is not a constant value, and is a variable that changes depending on the cylinder temperature. Specifically, when the cylinder temperature decreases, a time after the injection of fuel from the fuel injection valve 10 and before ignition, that is, a premix time during which the fuel and the cylinder gas are mixed increases. When the premix time increases, the diffusion of the fuel in the cylinder gas proceeds, and therefore, the smoke becomes less generated even when the air-fuel ratio becomes lower. That is, the smoke limit air-fuel ratio becomes lower as the cylinder temperature becomes lower, and the smoke limit air-fuel ratio becomes higher as the cylinder temperature becomes higher.

The cylinder temperature is determined by the amounts of the internal EGR gas and the external EGR gas and the temperature of the external EGR gas. The maximal amount of the internal EGR gas to be introduced is realized when the air-fuel ratio is the smoke limit air-fuel ratio. When the internal EGR gas amount is determined, the external EGR gas amount is also determined from the smoke limit air-fuel ratio. These relations among the parameters shows that the maximal amount of the internal EGR gas is determined by the temperature of the external EGR gas and further the maximal amount of the external EGR gas is determined by the temperature of the external EGR gas. In the following, a principle by which the maximal amount of the internal EGR gas is determined by the temperature of the external EGR gas will be described with use of FIG. 4A to FIG. 7B.

Figure 4A:
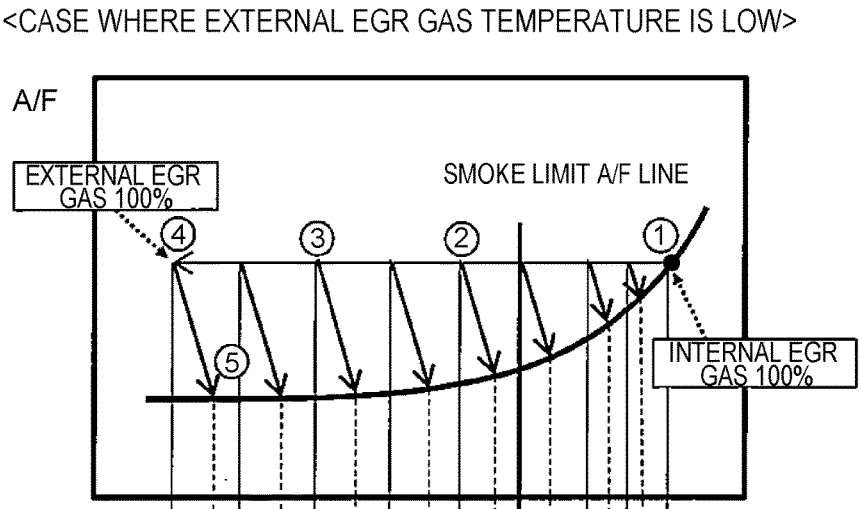
FIG. 4A is a diagram for describing a principle by which the maximal amount of an internal EGR gas is determined by the temperature of an external EGR gas, and is a diagram showing a relation of a cylinder temperature and a smoke limit air-fuel ratio.
Figure 5:
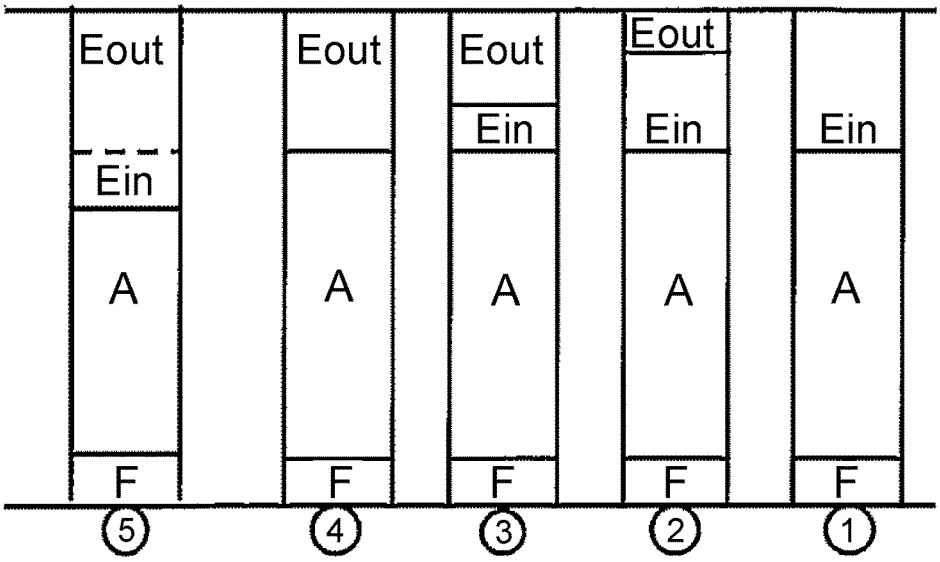
FIG. 5 is a diagram for supplementing the description with FIG. 4A and FIG. 4B, and is a diagram showing balances of gas amounts in a cylinder at operating points in FIG. 4A and FIG. 4B.

FIG. 4A is a diagram showing a relation of the cylinder temperature and the smoke limit air-fuel ratio. FIG. 4A shows five operating points of "1" to "5" with circles. The operating point "1" is on the smoke limit air-fuel ratio, and the ratio of the internal EGR gas in the EGR gas is 100%, at the operating point "1". When the ratio of the external EGR gas is increased while the air-fuel ratio at the operating point "1" is maintained, the cylinder temperature decreases depending on the ratio, and the operating point moves from the operating point "1" to the low-temperature side, in the order of the operating point "2", the operating point "3" and the operating point "4". When the ratio of the external EGR gas in the EGR gas is set to 100% at the operating point "4", the cylinder temperature becomes the lowest temperature. When the operating point moves to the low-temperature side while the air-fuel ratio is maintained, the smoke limit air-fuel ratio becomes lower as the temperature becomes lower, and therefore, a margin of the air-fuel ratio is produced with respect to the smoke limit air-fuel ratio. This margin can be used for increasing the amount of the internal EGR gas. By increasing the amount of the internal EGR gas until the air-fuel ratio reaches the smoke limit air-fuel ratio, the operating point moves from the operating point "4" to the operating point "5". Since the internal EGR gas having a high temperature is increased, the cylinder temperature at the operating point "4" is slightly higher than the cylinder temperature at the operating point "S". FIG. 5 is a bar graph showing balances of the gas amounts in the cylinder at the operating points shown in FIG. 4A. Ein indicates the internal EGR gas amount, Eout indicates the external EGR gas amount, A indicates the fresh air amount, and F indicates the fuel injection amount. The unit of the amounts is gram per cycle.

Figure 4B:
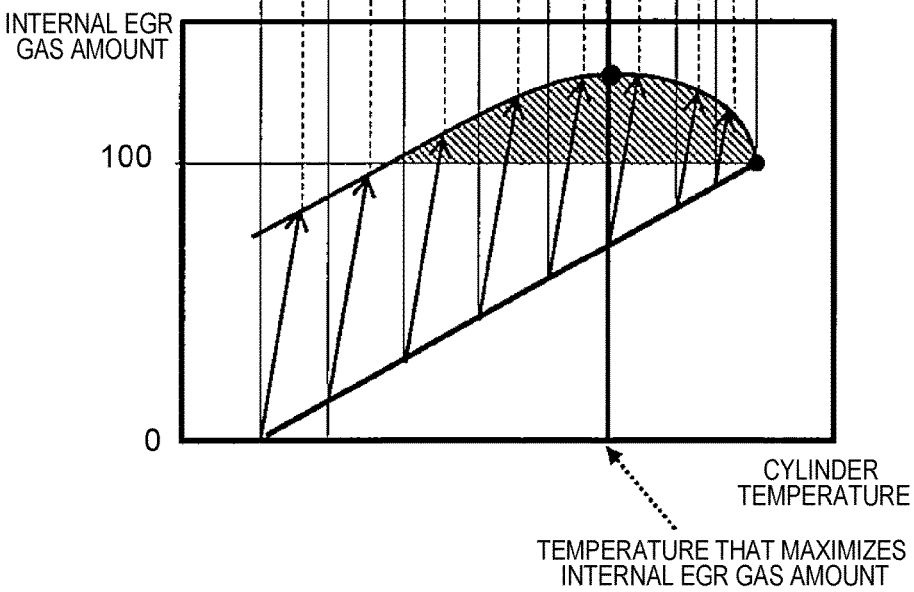
FIG. 4B is a diagram for describing the principle by which the maximal amount of the internal EGR gas is determined by the temperature of the external EGR gas, and is a diagram showing a relation of the cylinder temperature and an internal EGR gas amount.

FIG. 4B is a diagram showing a relation of the cylinder temperature and the internal EGR gas amount. As described above, by introducing the external EGR gas, it is possible to decrease the smoke limit air-fuel ratio compared to the case where the ratio of the internal EGR gas is 100%, and it is possible to increase the internal EGR gas amount by the produced margin amount with respect to the smoke limit air-fuel ratio. The curve shown in FIG. 41 is a curve obtained by plotting the internal EGR gas amount corresponding to the smoke limit air-fuel ratio for each cylinder temperature. A cylinder temperature at which the curve is locally maximized is a cylinder temperature at which the internal EGR amount can be maximized at the current external EGR gas temperature. The local maximal value of the curve is the maximal amount of the internal EGR gas that can be introduced at the current external EGR gas temperature.

Figure 6A:
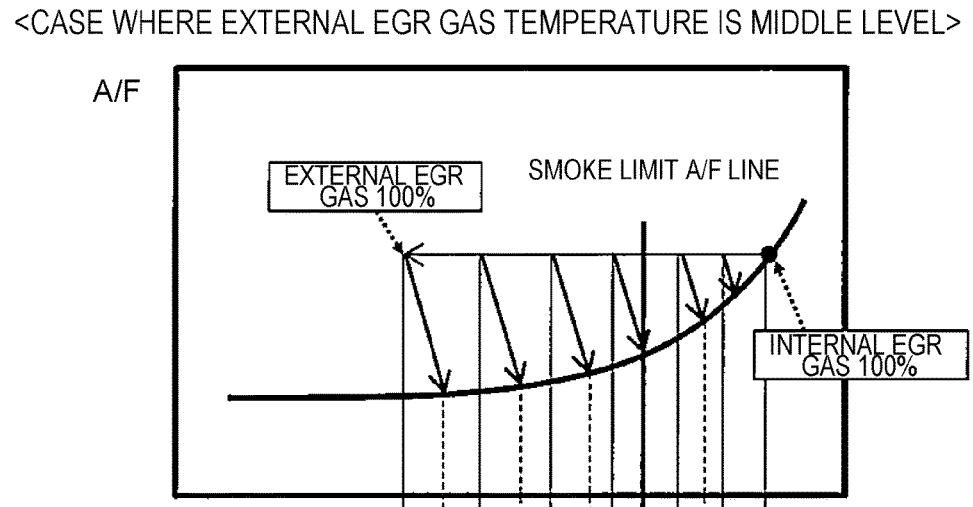
FIG. 6A is a diagram showing a relation of the cylinder temperature and the smoke limit air-fuel ratio in the case where an external EGR gas temperature is higher than that in the example shown in FIG. 4A.
Figure 6B:
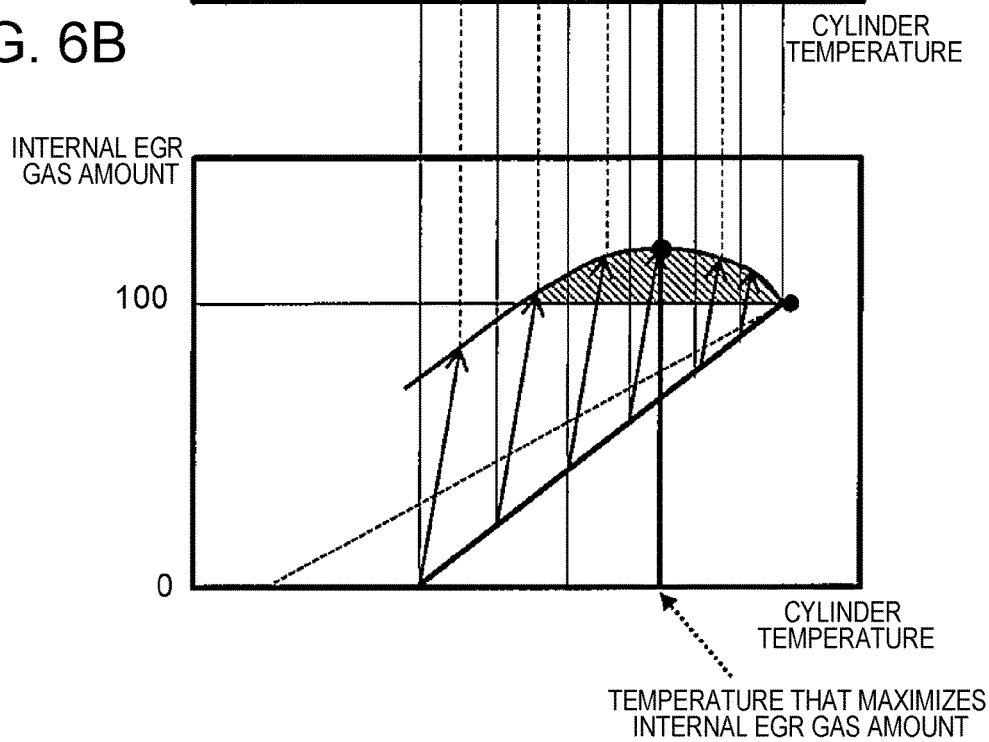
FIG. 6B is a diagram showing a relation of the cylinder temperature and the internal EGR gas amount in the case where the external EGR gas temperature is higher than that in the example shown in FIG. 4A.
Figure 7A:
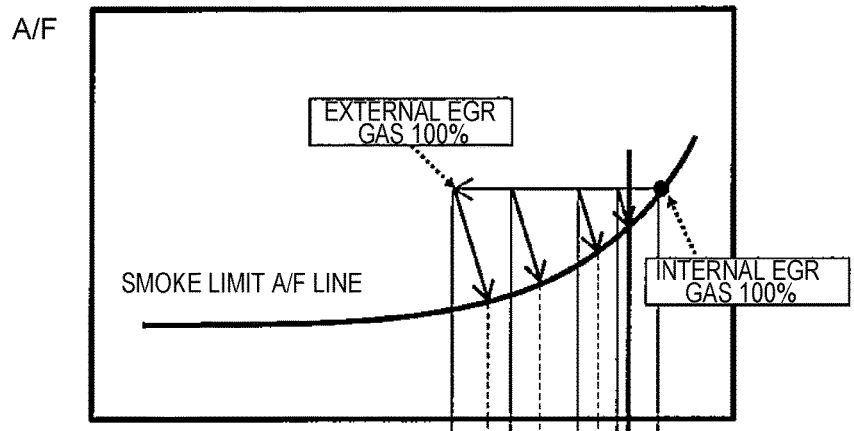
FIG. 7A is a diagram showing a relation of the cylinder temperature and the smoke limit air-fuel ratio in the case where the external EGR gas temperature is further higher than that in the example shown in FIG. 6A.
Figure 7B:
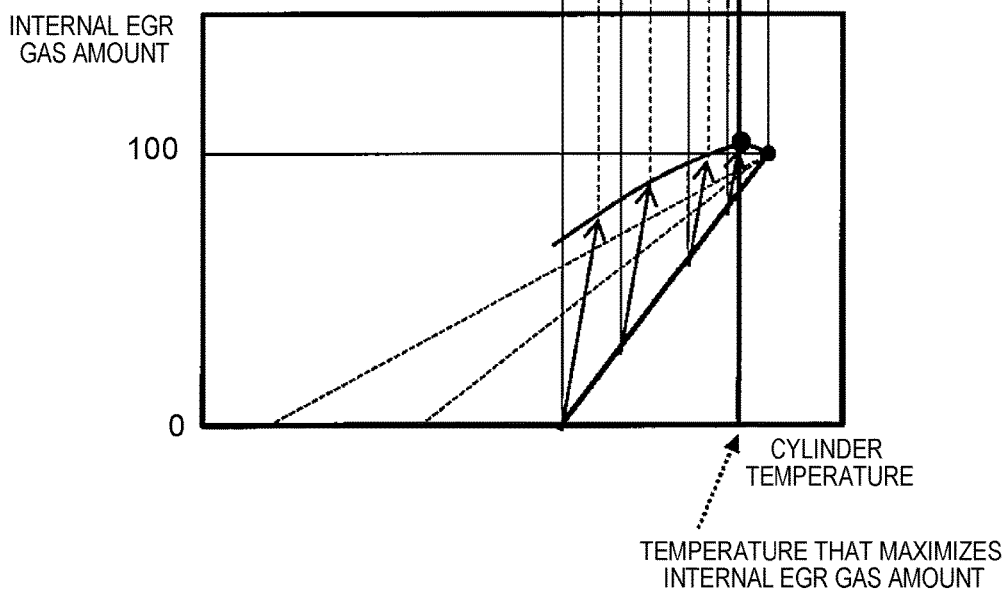
FIG. 7B is a diagram showing a relation of the cylinder temperature and the internal EGR gas amount in the case where the external EGR gas temperature is further higher than that in the example shown in FIG. 6A.

FIG. 6A is a diagram showing a relation of the cylinder temperature and the smoke limit air-fuel ratio in the case where the external EGR gas temperature is higher than that in the example shown in FIG. 4A, and FIG. 6B is a diagram showing a relation of the cylinder temperature and the internal EGR gas amount in that case. FIG. 7A is a diagram showing a relation of the cylinder temperature and the smoke limit air-fuel ratio in the case where the external EGR gas temperature is further higher than that in the example shown in FIG. 6A, and FIG. 7B is a diagram showing a relation of the cylinder temperature and the internal EGR gas amount in that case. As can be seen from the comparison of FIG. 4B, FIG. 6B and FIG. 7B, the maximal amount of the internal EGR gas that can be introduced decreases as the external EGR gas temperature becomes higher, and the maximal amount of the internal EGR gas that can be introduced increases as the external EGR gas temperature becomes lower.

Figure 8:
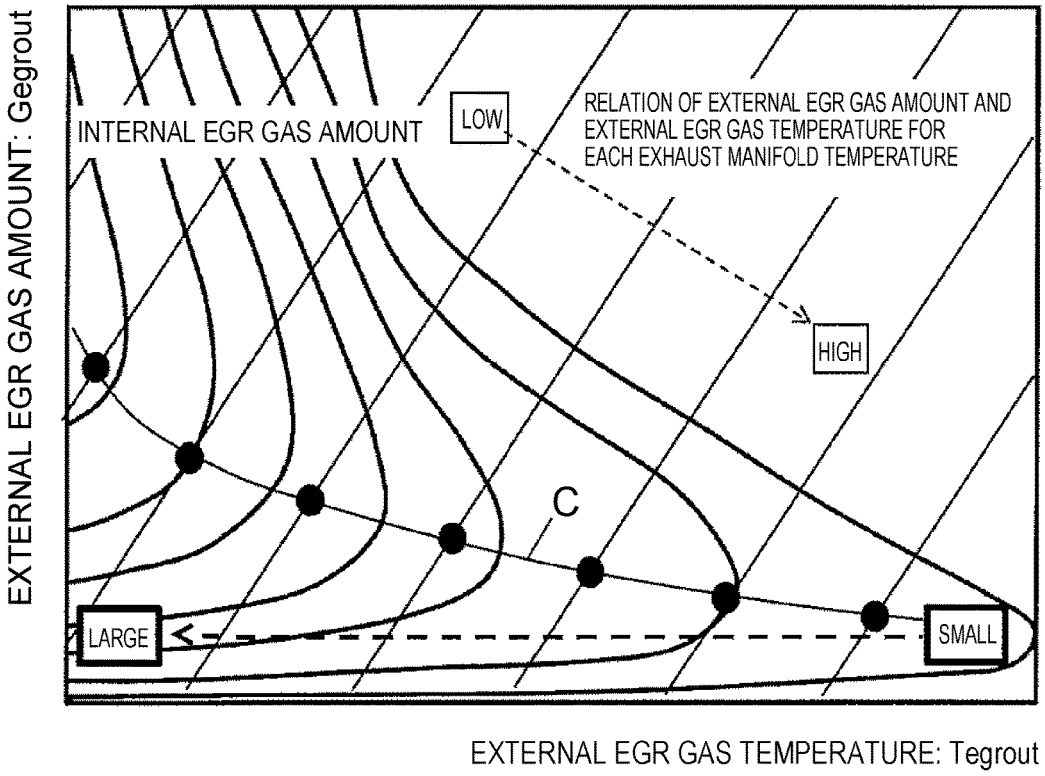
FIG. 8 is a diagram showing a relation of the external EGR gas temperature, an external EGR gas amount to be introduced and an internal EGR gas amount to be introduced.

FIG. 8 shows the above-described relations of the external EGR gas temperature, the internal EGR gas amount and the external EGR gas amount, as one graph. In the graph shown in FIG. 8, the ordinate indicates the external EGR gas amount, the abscissa indicates the external EGR gas temperature, and each of the curves shown in the graph is an equal-amount line that connects points having an equal internal EGR gas amount. An internal EGR gas amount indicated by an equal-amount line on a side where the external EGR gas temperature is lower is relatively larger, and an internal EGR gas amount indicated by an equal-amount line on a side where the external EGR gas temperature is higher is relatively smaller.

In the graph shown in FIG. 8, each of the straight lines drawn obliquely at equal intervals is an equal-temperature line that connects points having an equal exhaust manifold temperature (T4). When the exhaust manifold temperature is constant, the external EGR gas temperature becomes higher as the external EGR gas amount becomes larger. An exhaust manifold temperature indicated by an equal-temperature line on a side where the external EGR gas temperature is lower is relatively lower, and an exhaust manifold temperature indicated by an equal-temperature line on a side where the external EGR gas temperature is higher is relatively higher.

Each of the circles shown in FIG. 8 indicates a point at which the internal EGR gas amount is maximized on the equal-temperature line. Therefore, a curve C obtained by connecting the circles on the equal-temperature lines is a curve indicating a relation of the external EGR gas temperature and the external EGR gas amount that allow the internal EGR gas amount to be maximized. The relation of the external EGR gas temperature and the external EGR gas amount indicated by the curve C and the relation of the external EGR gas temperature and the internal EGR gas amount that are indicated by the curve C are used in the deposit removal operation by the control device 100.

In the deposit removal operation by the control device 100, the opening degree of the EGR valve 32 and the lift amount of the intake valve 8 are determined according to the temperature of the external EGR gas, such that a fresh air amount ensuring that the air-fuel ratio of the cylinder gas does not fall below the smoke limit air-fuel ratio as the rich limit to become rich is secured. Further, in the deposit removal operation by the control device 100, the opening degree of the EGR valve 32 and the lift amount of the intake valve 8 are determined, such that the amount of the combustion gas that is blown back from the intake valve 8 to the intake port is maximized. In the following, each determination method for the opening degree of the EGR valve 32 and the lift amount of the intake valve 8 in the deposit removal operation will be described in detail.

2-3. Determination of Opening Degree of EGR Valve

Figure 9A:
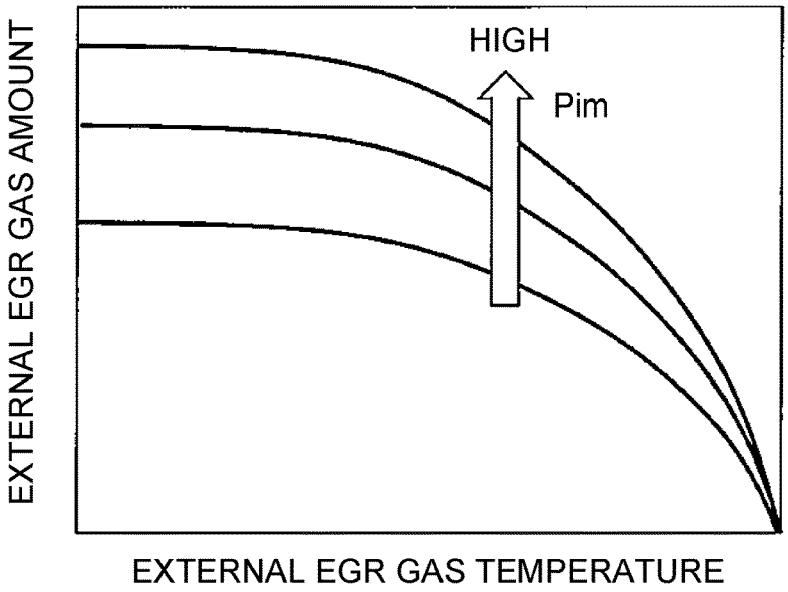
FIG. 9A is a diagram showing an outline of a map that is used for determining the external EGR gas amount to be introduced, from the external EGR gas temperature.

In the deposit removal operation, the external EGR gas amount is determined from the external EGR gas temperature, with use of a map shown as an outline in FIG. 9A. This map is a map showing the relation of the external EGR gas temperature and the external EGR gas amount that is indicated by the curve C in FIG. 8. The external EGR gas temperature is calculated based on the exhaust manifold temperature (T4) measured by the temperature sensor 56. In detail, the external EGR gas temperature is the temperature of the external EGR gas at an outlet of the EGR valve 32. However, the change in the temperature by the passing through the EGR valve 32 may be ignored, and the temperature of the external EGR gas at an inlet of the EGR valve 32 may be used as the external EGR gas temperature. The temperature of the external EGR gas at the inlet of the EGR valve 32 can be calculated based on the exhaust manifold temperature and the exhaust manifold pressure, using a physical model of the EGR cooler 33. A temperature sensor may be disposed at the inlet of the EGR valve 32, and the temperature of the external EGR gas may be measured by the temperature sensor.

Figure 9B:
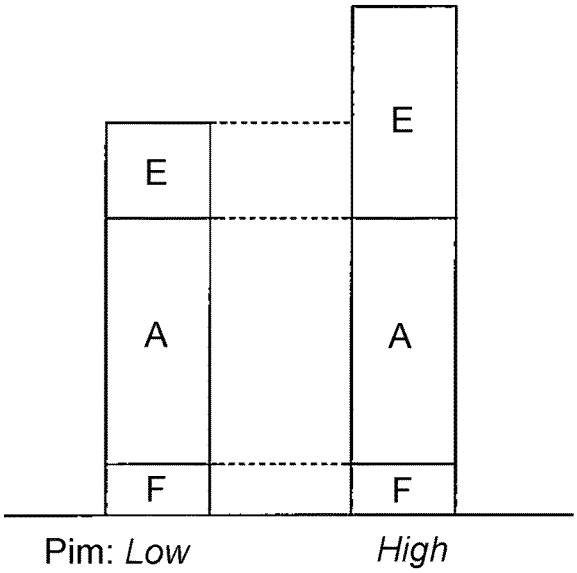
FIG. 9B is a diagram for supplementing the description with FIG. 9A showing the outline of the map that is used for determining the external EGR gas amount to be introduced, from the external EGR gas temperature.

In the relation of the external EGR gas temperature and the external EGR gas amount that is shown in FIG. 9A, the external EGR gas amount to be introduced is increased as the external EGR gas temperature becomes lower. Further, the external EGR gas amount to be introduced is increased as the intake manifold pressure (Pim) measured by the pressure sensor 52 becomes higher. FIG. 9B is a bar graph showing a balance (High) of the cylinder gas amounts in the case where the intake manifold pressure (Pim) is high and a balance (Low) of the cylinder gas amounts in the case where the intake manifold pressure (Pim) is low. E indicates the total of the internal EGR gas amount and the external EGR gas amount, A indicates the fresh air amount, and F indicates the fuel injection amount. In the case where the intake manifold pressure is high, the total of the cylinder gas amounts becomes larger than in the case where the intake manifold pressure is low. By increasing or decreasing the external EGR gas amount depending on the intake manifold pressure, it is possible to keep the air-fuel ratio A/F constant regardless the total of the cylinder gas amounts.

After the external EGR gas amount is determined, next, the opening degree of the EGR valve 32 for realizing the determined external EGR gas amount is determined. Here, fluid to pass through a nozzle satisfies the Bernoulli's principle from the energy conservation law. According to the Bernoulli's principle, the effective opening area of the nozzle can be expressed by the following equation, for example. In the equation, μA is the effective opening area, m is the flow rate of gas to pass through the nozzle, Pin is the pressure at an inlet of the nozzle, Tin is the temperature at the inlet of the nozzle, Pout is the pressure at an outlet of the nozzle, a and b are coefficients, and R is a gas constant.

$$\mu A = \frac{m \times \sqrt{\frac{R \times Tin}{2}}}{b \times Pin + a \times Pout} \quad \text{[Equation 1]}$$

The above equation can be also applied to the EGR valve 32. In that case, Pin and Tin can be calculated based on the exhaust manifold pressure (P4) and the exhaust manifold temperature (T4), using the physical model of the EGR cooler. A temperature sensor and a pressure sensor may be disposed at the inlet of the EGR valve 32, and Pin and Tin may be directly measured by the temperature sensor and the pressure sensor. The intake manifold pressure (Pim) measured by the pressure sensor 52 is assigned to Pout. The external EGR gas amount, which is mass per cycle, is converted into mass per second, and thereby, m is obtained.

Figure 10:
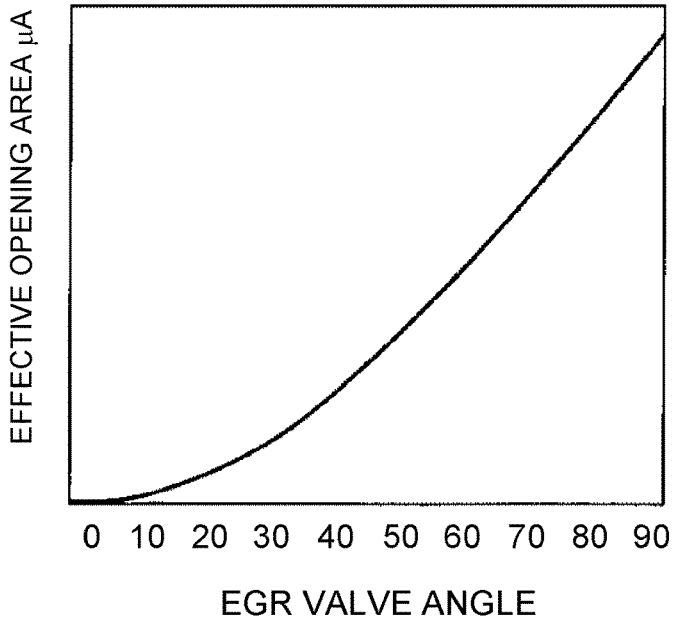
FIG. 10 is a diagram showing an outline of a map that is used for determining the opening degree of an EGR valve from an effective opening area.

After the effective opening area μA of the EGR valve 32 is calculated using the above equation, next, the opening degree of the EGR valve 32 is calculated from the effective opening area μA. In the calculation of the opening degree of the EGR valve 32, a map shown as an outline in FIG. 10 is used. In the map, the opening degree of the EGR valve 32 is indicated by an angle that is 0 degrees in a fully closed state and is 90 degrees in a fully opened state. The control device 100 sets the opening degree determined using the map, as a target opening degree, to operate the EGR valve 32.

Figure 11:
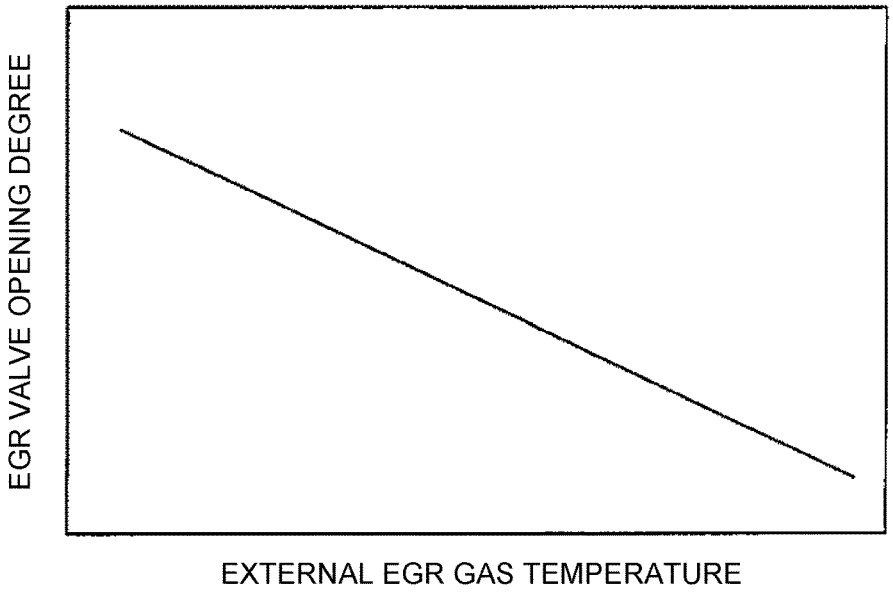
FIG. 11 is a diagram showing a relation of the external EGR gas temperature and the opening degree of the EGR valve.

FIG. 11 is a diagram showing a relation of the external EGR gas temperature and the opening degree of the EGR valve 32 in the deposit removal operation. As shown in this figure, the opening degree of the EGR valve 32 is increased as the external EGR gas temperature becomes lower. By this operation, it is possible to increase the amount of the external EGR gas that is recycled to the intake passage 14, as the external EGR gas temperature becomes lower.

2-4. Determination of Lift Amount of Intake Valve

Figure 12:
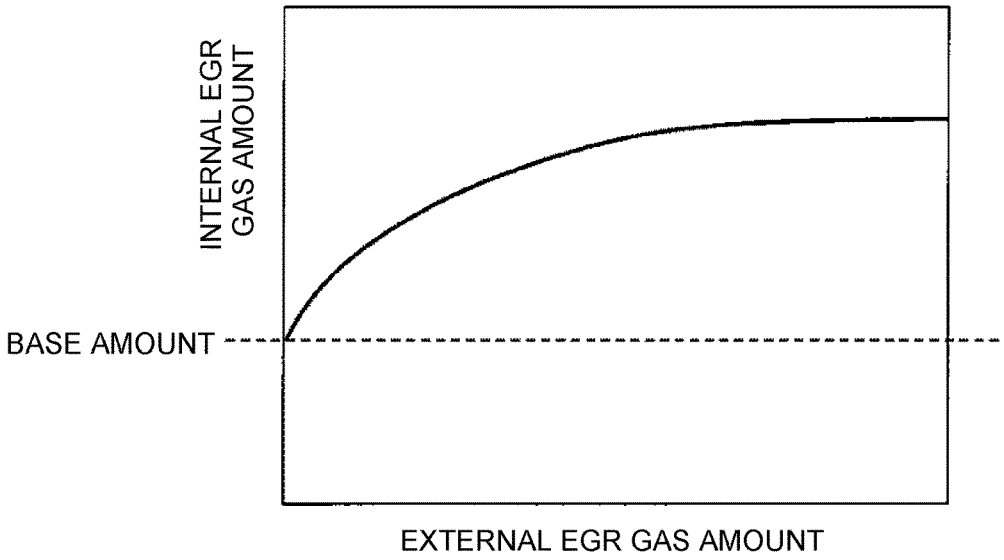
FIG. 12 is a diagram showing an outline of a map that is used for determining the internal EGR gas amount to be introduced, from the external EGR gas amount to be introduced.

In the deposit removal operation, the internal EGR gas amount to be introduced is determined based on the external EGR gas amount obtained using the map shown in FIG. 9A. In the determination of the internal EGR gas amount, a map shown as an outline in FIG. 12 is used. This map is a map showing the relation of the external EGR gas amount and the internal EGR gas amount that is indicated by the curve C in FIG. 8. Therefore, the internal EGR gas amount determined by this map is the maximal amount of the internal EGR gas that can be introduced at the current external EGR gas temperature. As shown in FIG. 12, when the external EGR gas amount is zero, the internal EGR gas amount is a base amount that is a minimal amount. The base amount is an amount when the air-fuel ratio of the cylinder gas becomes the smoke limit air-fuel ratio by the introduction of only the internal EGR gas. In the map shown in FIG. 12, the internal EGR gas amount to be introduced becomes larger as the external EGR gas amount to be introduced becomes larger.

After the internal EGR gas amount is determined, next, the lift amount of the intake valve 8 for realizing the determined internal EGR gas amount is determined. Here, the determined lift amount is a lift amount when the intake valve 8 is opened in the expansion stroke or the exhaust stroke. The amount of the gas that is blown back from the intake valve 8 to the intake port 6 is proportional to the effective opening area of the intake valve 8, and is proportional to the differential pressure between the cylinder pressure (Pcyl) and the intake manifold pressure (Pim) when the intake valve 8 is opened. Further, the effective opening area of the intake valve 8 is proportional to the lift amount of the intake valve 8. Therefore, the lift amount of the intake valve 8 can be expressed by the following equation. In the equation, VL is the lift amount, Gegrin is the internal EGR gas amount to be introduced, Pcyl is the cylinder pressure at the timing when the intake valve 8 is opened, Pim is the intake manifold pressure at the timing when the intake valve 8 is opened, and c is a coefficient. The control device 100 sets the lift amount of the intake valve 8 determined using the following equation, as a target lift amount, to operate the variable valve mechanism 11.

$$VL = c \times \frac{Gegrin}{Pcyl - Pim} \quad \text{[Equation 2]}$$

Figure 13:
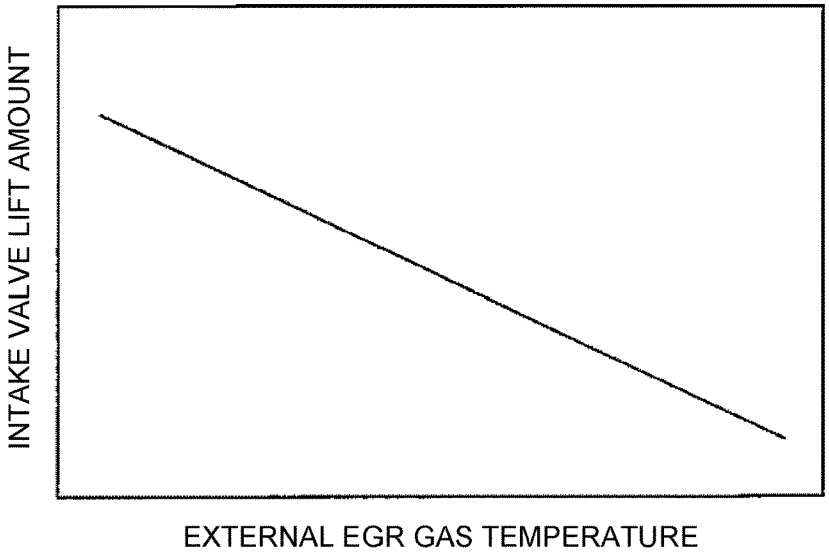
FIG. 13 is a diagram showing a relation of the external EGR gas temperature and the lift amount of the intake valve when the intake valve is opened for the second time.

FIG. 13 is a diagram showing a relation of the external EGR gas temperature and the lift amount of the intake valve 8 in the deposit removal operation. As shown in this figure, the lift amount of the intake valve 8 is increased as the external EGR gas temperature becomes lower. By this operation, it is possible to increase the internal EGR gas amount, that is, the amount of the high-temperature combustion gas that is blown back from the intake valve 8 to the intake port 6 in the expansion stroke or the exhaust stroke, as the external EGR gas temperature becomes lower.

2-5. Procedure of Deposit Removal Operation

Figure 14:
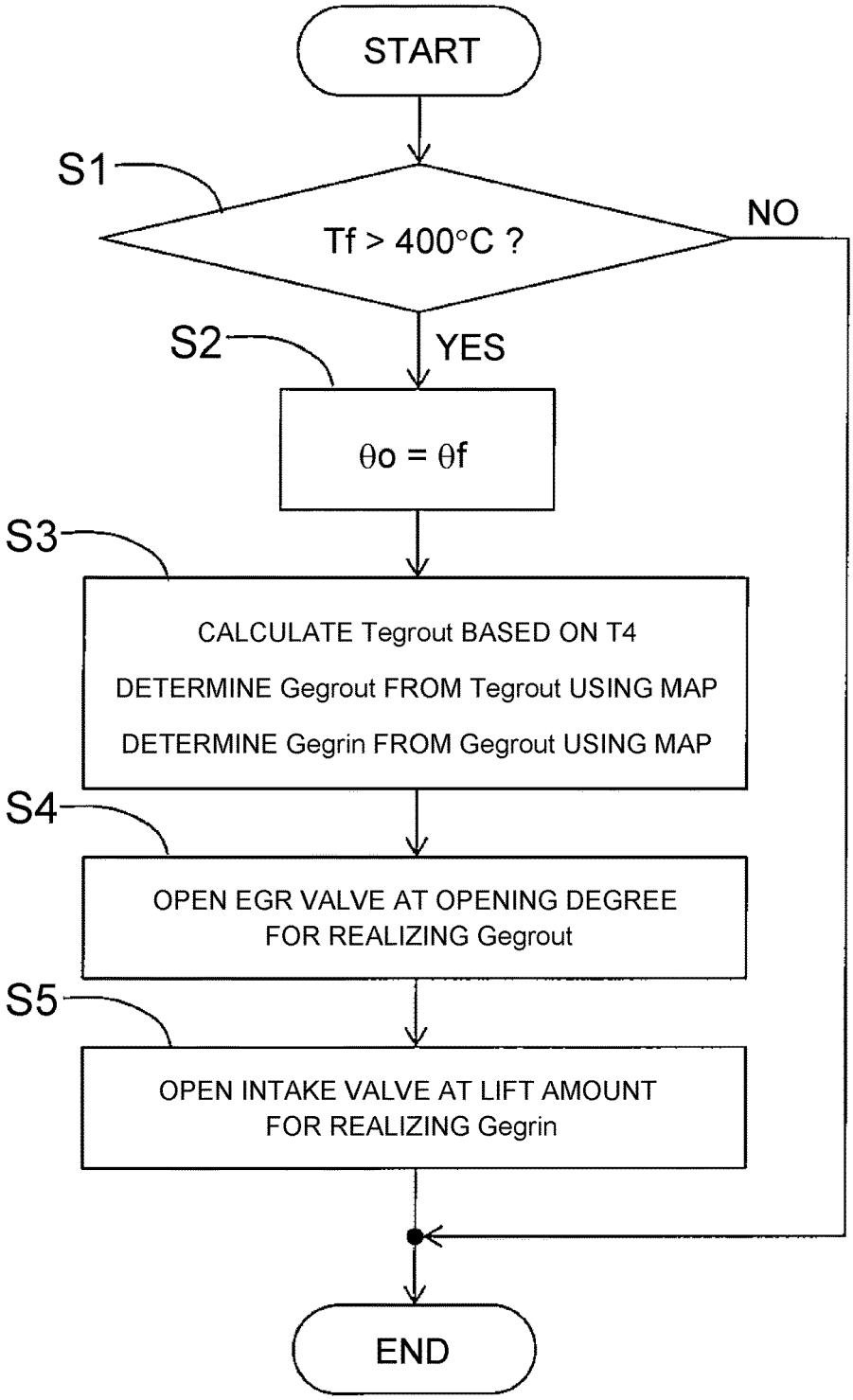
FIG. 14 is a diagram showing a procedure of the deposit removal operation that is executed by the control device in the embodiment of the disclosure.

FIG. 14 is a diagram showing a procedure of the deposit removal operation that is executed by the control device 100. A program created based on the procedure shown in FIG. 14 is stored in the ROM of the control device 100. The program is loaded on the RAM and is executed by the CPU, so that a function for the deposit removal operation is given to the control device 100.

In step S1, an average cylinder temperature (Tf) at the time point when the combustion is completed is calculated based on the cylinder pressure measured by the pressure sensor 58. The time point when the combustion is completed is the time point when the heat generation rate has become zero or has become equal to or lower than the threshold. The heat generation rate is calculated based on the cylinder pressure. As another method for obtaining the average cylinder temperature, there is a method of using a map that includes engine speed and fuel injection amount as parameters. The engine speed and the fuel injection amount are related to the cylinder temperature, and therefore, by researching the relation of them and preparing the map in advance, it is possible to predict the average cylinder temperature at the time of the completion of the combustion, from the engine speed and the fuel injection amount. Subsequently, in step S1, it is determined whether the average cylinder temperature at the time of the completion of the combustion is higher than a temperature allowing the deposit to be burnt up and removed, for example, 400° C.

In the case where the average cylinder temperature is not sufficiently high, the deposit cannot be sufficiently burnt up even if the combustion gas is blown back to the intake port 6. Therefore, in the case where the average cylinder temperature is equal to or lower than 400° C., which is a standard of the temperature allowing the deposit to be burnt up and removed, the execution of the deposit removal operation is suspended. When the average cylinder temperature exceeds 400° C. as the standard temperature, processes of step S2 to step S5 are performed.

In step S2, a crank angle θf at the time point when the combustion is completed in the last cycle is set as a crank angle θo for the second opening of the intake valve 8 in the current cycle. In this step, for maximizing the temperature of the combustion gas that is blown back to the intake port 6 when the intake valve 8 is opened in the expansion stroke or the exhaust stroke, the opening timing of the intake valve 8 is advanced at a maximum. Here, whether the timing of the second opening of the intake valve 8 is in the expansion stroke or in the exhaust stroke is determined by the crank angle θf at the time point when the combustion is completed.

In step S3, the external EGR gas temperature (Tegrout) is calculated based on the exhaust manifold temperature (T4) measured by the temperature sensor 56. Then, from the external EGR gas temperature (Tegrout), the external EGR gas amount (Gegrout) is determined using the map shown in FIG. 9A. Further, from the external EGR gas amount (Gegrout), the internal EGR gas amount (Gegrin) is determined using the map shown in FIG. 12.

In step S4, the opening degree of the EGR valve 32 for realizing the external EGR gas amount (Gegrout) determined in step S3 is calculated. Then, the calculated opening degree is set as the target opening degree, and the EGR valve 32 is operated.

In step S5, the lift amount of the intake valve 8 for realizing the internal EGR gas amount (Gegrin) determined in step S3 is calculated. Then, the calculated lift amount is set as the target lift amount of the intake valve 8, and the variable valve mechanism 11 is operated.

By executing the deposit removal operation in the above procedure, it is possible to increase the amount of the combustion gas that is blown back to the intake port 6, while suppressing the rise in the cylinder temperature. Therefore, it is possible to burn up the deposit accumulated in the intake port 6 without causing the deterioration in the fuel economy performance or the exhaust performance.

3. Other Embodiments

The above-described internal combustion engine according to the embodiment is a diesel engine. However, internal combustion engines to which the disclosure can be applied are not limited to diesel engines. For example, the disclosure can be applied to gasoline engines.

What is claimed is:

1. A control device for an internal combustion engine, the internal combustion engine including: a variable valve mechanism that is configured to open an intake valve in an expansion stroke or an exhaust stroke and is configured to change a lift amount of the intake valve; and an external EGR device that is configured to recycle an EGR gas from an exhaust passage to an intake passage, the control device comprising:

an electronic control unit, the electronic control unit being configured to execute a deposit removal operation of removing a deposit accumulated in an intake port of the internal combustion engine, the deposit removal operation comprising:

(i) measuring or estimating a temperature of the EGR gas that is recycled to the intake passage;

(ii) operating the variable valve mechanism such that the intake valve is opened in the expansion stroke or the exhaust stroke, and the lift amount of the intake valve becomes larger as the measured or estimated temperature of the EGR gas becomes lower; and (iii) operating the external EGR device such that an amount of the EGR gas that is recycled to the intake passage becomes larger as the measured or estimated temperature of the EGR gas becomes lower.

2. The control device according to claim 1, wherein the electronic control unit is configured to determine an operation amount of the variable valve mechanism and an operation amount of the external EGR device, depending on the measured or estimated temperature of the EGR gas, such that a fresh air amount ensuring that an air-fuel ratio of a cylinder gas does not fall below a rich limit to become rich is secured, when the electronic control unit executes the deposit removal operation.

3. The control device according to claim 2, wherein the electronic control unit is configured to determine the operation amount of the variable valve mechanism and the operation amount of the external EGR device, such that an amount of a combustion gas that is blown back from the intake valve to the intake port is maximized, when the electronic control unit executes the deposit removal operation.

4. The control device according to claim 1, wherein the electronic control unit is configured to execute the deposit removal operation, when it is estimated that a cylinder temperature at a time of combustion completion is equal to or higher than a predetermined temperature allowing the deposit to be burnt up and removed.

5. The control device according to claim 4, wherein the electronic control unit is configured to operate the variable valve mechanism, such that an opening timing of the intake valve is a timing of the combustion completion, when the electronic control unit executes the deposit removal operation.

6. The control device according to claim 1, wherein the internal combustion engine is a diesel internal combustion engine.

7. A control method of an internal combustion engine, the internal combustion engine including: a variable valve mechanism that is configured to open an intake valve in an expansion stroke or an exhaust stroke and is configured to change a lift amount of the intake valve; and an external EGR device that is configured to recycle an EGR gas from an exhaust passage to an intake passage, the control method comprising:

executing a deposit removal operation of removing a deposit accumulated in an intake port of the internal combustion engine, the deposit removal operation comprising:

(i) measuring or estimating a temperature of the EGR gas that is recycled to the intake passage;

(ii) operating the variable valve mechanism such that the intake valve is opened in the expansion stroke or the exhaust stroke, and the lift amount of the intake valve becomes larger as the measured or estimated temperature of the EGR gas becomes lower; and (iii) operating the external EGR device such that an amount of the EGR gas that is recycled to the intake passage becomes larger as the measured or estimated temperature of the EGR gas becomes lower.

* * * * *